United States Patent [19]

Reidick et al.

[11] 4,446,911

[45] May 8, 1984

[54] REGENERATIVE PREHEATER FOR TWO SEPARATE GAS STREAMS

[75] Inventors: H. Reidick, Oberhausen; R. Leithner, Neuhausen; F. J. Kirchhoff, Olpe; E. Puritz, Dahlbruch; S. Schlüter, Wenden, all of Fed. Rep. of Germany

[73] Assignee: Apparatebau Rothemühle Brandt & Kritzler GmbH, Wenden, Fed. Rep. of Germany

[21] Appl. No.: 433,677

[22] Filed: Oct. 12, 1982

[30] Foreign Application Priority Data

Oct. 12, 1981 [DE] Fed. Rep. of Germany ..... 3140406

[51] Int. Cl.[3] ..... F28D 17/00

[52] U.S. Cl. ..... 165/4; 165/7

[58] Field of Search ..... 165/7, 4

[56] References Cited

U.S. PATENT DOCUMENTS

| | | | |
|---|---|---|---|
| 2,337,907 | 12/1943 | Lundstrom | 165/7 |
| 2,347,857 | 5/1944 | Waitkus | 165/7 |
| 3,321,011 | 5/1967 | Kalbfleisch et al. | 165/7 |

FOREIGN PATENT DOCUMENTS

| | | | |
|---|---|---|---|
| 2418902 | 10/1975 | Fed. Rep. of Germany | 165/7 |
| 275231 | 4/1928 | United Kingdom . | |
| 311889 | 5/1929 | United Kingdom . | |
| 595465 | 12/1947 | United Kingdom . | |
| 1022356 | 3/1966 | United Kingdom . | |
| 1330615 | 9/1973 | United Kingdom . | |
| 1344589 | 1/1974 | United Kingdom . | |
| 1431289 | 4/1976 | United Kingdom . | |
| 1572022 | 7/1980 | United Kingdom . | |
| 320676 | 1/1972 | U.S.S.R. | 165/7 |

*Primary Examiner*—Albert W. Davis, Jr.

*Attorney, Agent, or Firm*—Karl F. Ross; Herbert Dubno

[57] ABSTRACT

A regenerative air preheater has a heat-exchange sector plate centered on an axis and formed with a multiplicity of axially throughgoing passages with intake and output heating-gas hoods axially flanking the plate and conduits for passing a heating gas from the intake hood through the plate to the output hood for heating the plate. Intake and output secondary heated-gas hoods each within one of the heating-gas hoods and axially flanking the plate are axially aligned with each other and only cover a portion of the plate. Thus the heating gas can pass through the plate only around the plate portion covered by the secondary hoods. Intake and output primary heated-gas hoods within the respective secondary hoods and axially flanking the plate are axially aligned with each other and only cover a subportion of the plate portion covered by the secondary hoods. Thus the secondary gas will be heated at regions of the plate portion not covered by the primary hoods. A drive rotates the secondary hoods synchronously with each other about the axis in a predetermined rotational sense. Thus the heating gas will heat regions of the plate not covered by the secondary hoods so that when same move into alignment with these heated regions the secondary gas stream will be heated. Portions of the primary hoods can be displaced nonaxially within the respective secondary hoods and to vary the heat-exchange between the primary stream and the plate.

8 Claims, 12 Drawing Figures

66
67
76
78'
75
79'
78"
70
79"
62
VIII
VIII
61
61'
61"
61'''
77'
77"

61'
61'
62
61'
73'
73"
80'
83"
81"
77"
72'
78"
79"
72"
74"
74'
70
82"
79'
78'
80"
81'
82'
83'
73'
73"
77'

REGENERATIVE PREHEATER FOR TWO SEPARATE GAS STREAMS

FIELD OF THE INVENTION

The present invention relates to a regenerative preheater for two separate gas streams. More particularly this invention concerns such a preheater which allows a primary and secondary gas stream to be separately heated by indirect heat exchange with the same hot gas.

BACKGROUND OF THE INVENTION

As described in commonly owned U.S. patent application Ser. No. 408,729 filed 17 Aug. 1982 by H. Sandmann, an air preheater has a stator-type sector plate formed as a large wheel centered on an upright axis and forming a multiplicity of axially throughgoing passages that are angularly and radially separate and that are packed with heat-storing plates or the like constituting the thermal mass of the system. Upper and lower hoods are fitted over the upper and lower axially directed faces of this plate to subdivide the air flows through the plate so that the different streams can pass through the various passages, even in different directions. In this manner hot exhaust gases can give up their heat to the thermal mass while combustion-supporting gases, normally air, can then pick up this heat.

In German patent application 2,162,248 published 20 June 1973 a system is disclosed where the hoods are of butterfly shape in axial projection, each being formed by two diametrally opposite 90° segments. Hot exhaust gases can flow through half of the segments in one direction while cooler combustion gases flow in the opposite direction. The hoods are moved continuously or stepwise angularly to change the alignment and allow the heated thermal mass or matrix to give off its heat to the combustion gases. As a rule the hoods are journaled on a post fixed in the center of the stator, and carry seals closely juxtaposed with the respective faces thereof.

It is also known, as for example from German utility model 1,883,925 and German patent publication 2,418,902, to heat two separate gas streams in such an arrangement. As further described in "Regenerativ-Luftvorwarmer" (*Jahrbuch der Dampferzeugungstechnik* vol. 4, 1980; Vulkan-Verlag: Essen) such an arrangement is used in an arrangement wherein coal is ground and then used as fuel. A high-pressure and high-temperature primary gas stream, normally air, is used to transport the ground coal from the mill, to dry it, to air-classify it, and to transport it to the burner. A low-pressure and relatively low-temperature secondary gas stream, normally also air, is fed to the burner as combustion gas.

In such an arrangement the primary stream accounts for 15% to 25% of the overall flow of heated gas, as distinguished from the heating gas that warms the thermal mass of the system, and the secondary gas stream accounts for the balance. The primary stream is normally at a pressure of 100 mbar to 150 mbar whereas the secondary stream is at about 50 mbar.

In coaldust-fired burners the exact quantity and temperature for the primary stream varies with circumstances so that it is necessary to be able to vary the temperature and flow-volume of this primary stream independently of the secondary stream. The moisture content of the coal can vary between about 4% and 25% by weight, so that the volume and/or temperature of the primary stream must be variable by a factor of about six to produce combustible coal dust of the required high degree of dryness.

Since the standard multistream sector-plate preheater simply has a partitioned hood that allows two separate streams to flow through it, it is impossible to vary the temperature by varying the heat exchange. Hence it is standard practice to design the system to produce a primary stream that is at the hottest usable temperature. When this high temperature is not needed the primary stream is adulterated with cooler air to bring its temperature down to the desired level. This arrangement wastes the heat of the exhaust gases and lowers the pressure of the primary gas.

It is known in systems with the hoods subdivided into concentric sections to limit the flow of heating gas to the preheater, so as to reduce the heat imparted to the thermal mass and eventually to the primary and secondary streams of heated gas. Such a system ignores the fact that an important function of the air preheater is to cool the heating gases so that they can subsequently be filtered, normally in an electrostatic precipitator. As a result the subsequent filtering is less efficient or the filter is damaged by the inadequately cooled gases, which are typically the burner stack gases. In addition this type of arrangement reduces the heating of the secondary stream while reducing that of the primary stream, so it has not met with any widespread acceptance.

OBJECTS OF THE INVENTION

It is therefore an object of the present invention to provide an improved regenerative multistream preheater.

Another object is the provision of such a regenerative multistream preheater which overcomes the above-given disadvantages.

A further object is to provide a regenerative preheater whereby the temperature and/or flow volume of the primary and secondary streams can be adjusted without changing the flow volume of the heating gas.

SUMMARY OF THE INVENTION

These objects are attained according to the instant invention in a regenerative air preheater having a standard heat-exchange sector plate centered on an axis and formed with a multiplicity of axially throughgoing passages with intake and output heating-gas hoods axially flanking the plate and conduit means for passing a heating gas from the intake hood through the plate to the output hood for heating the plate. Intake and output secondary heated-gas hoods each within one of the heating-gas hoods and axially flanking the plate are axially aligned with each other and only cover a portion of the plate. Thus the heating gas can pass through the plate only around the plate portion covered by the secondary hoods. Conduit means passes a secondary stream of a gas to be heated from the intake secondary hood through the plate at the plate portion covered by the secondary hoods to the output secondary hood and drive means rotates the secondary hoods synchronously with each other about the axis in a predetermined rotational sense. Thus the heating gas will heat regions of the plate not covered by the secondary hoods so that when same move into alignment with these heated regions the secondary gas stream will be heated. Intake and output primary heated-gas hoods within the respective secondary hoods and axially flanking the plate are axially aligned with each other and only cover a subportion of the plate portion covered by the secondary hoods. Thus the secondary gas will be heated at regions of the plate portion not covered by the primary hoods. Conduit means passes a primary stream of a gas to be heated from the intake primary hood through the plate subportion aligned with it to the output primary hood. Control means displaces the primary hoods at least partially nonaxially within the respective secondary hoods and thereby varies the heat-exchange between the primary stream and the plate.

According to one style of operation according to the invention the primary hoods are generally radially coextensive with the respective secondary hoods and are movable angularly therein. The subportion of the primary hoods can lead the portion of the second hoods relative to the rotational sense to increase heat exchange with the primary stream and can follow it to decrease such heat exchange. Putting the primary hoods in intermediate positions allows fine control of the heat-exchange rate.

In accordance with another feature of the invention the primary hoods each have at least one wall movable nonaxially in and at least partially bounding the respective secondary hoods. These walls can be movable radially in the respective secondary hoods between an outer position maximizing the area of the subportion and thereby maximizing the heat exchange and an inner position minimizing the area and heat exchange. The radially movable walls are U-shaped and open toward the axis.

It is also possible according to this invention for the secondary hoods each to have at least two generally radially extending side walls angularly bounding the respective portion. In this case the movable walls each include an angularly extending outer portion, an angularly extending inner portion spaced radially inward from the respective outer portion, and an intermediate portion extending angularly between the respective inner and outer portions. The side walls of the secondary hoods have inner and outer slots receiving the respective portions and the movable wall are angularly shiftable in the slots between a position with the intermediate portion against one side wall and the outer portion generally bridging the side walls and a position with the intermediate portion against the other side wall and the inner portion generally bridging the side walls. When the outer wall portion is bridging the side walls the flow cross section of the primary hoods is maximized and when the inner wall portion is bridging the side walls it is minimized, with intermediate positions creating intermediate flow sizes.

According to another feature of this invention the primary-gas conduit means opens generally at the axis into the primary hoods and the secondary-gas conduit means opens offset from the axis into the secondary hoods. The movable walls are each displaceable between a position extending generally radially between the respective side walls with the primary and secondary hoods generally radially coextensive, and a position extending secantally between the respective side walls with the primary hood between the secondary hood and the axis. In the former position a change in rotation direction can affect the heat exchange as described above.

The preheater according to the invention can have walls between and bounding each primary hood and the respective secondary hood and forming therebetween a compartment open axially toward the sector plate. The walls bounding the primary hoods are formed with primary ports opening thereinto and the walls bounding the secondary hoods are formed with secondary ports opening thereinto. Alternately opening and closing primary and secondary doors at the respective ports constituting part of the control means can be operated to vary the flow cross section. With the primary doors open and the secondary doors closed the effective surface area of the primary hoods is increased by that of the compartment and vice versa. These walls can extend secantally between the respective primary and secondary hoods. They can also extend radially between the respective primary and secondary hoods.

DESCRIPTION OF THE DRAWING

The above and other features and advantages will become more readily apparent from the following, reference being made to the accompanying drawing in which.

SPECIFIC DESCRIPTION

Figure 1:
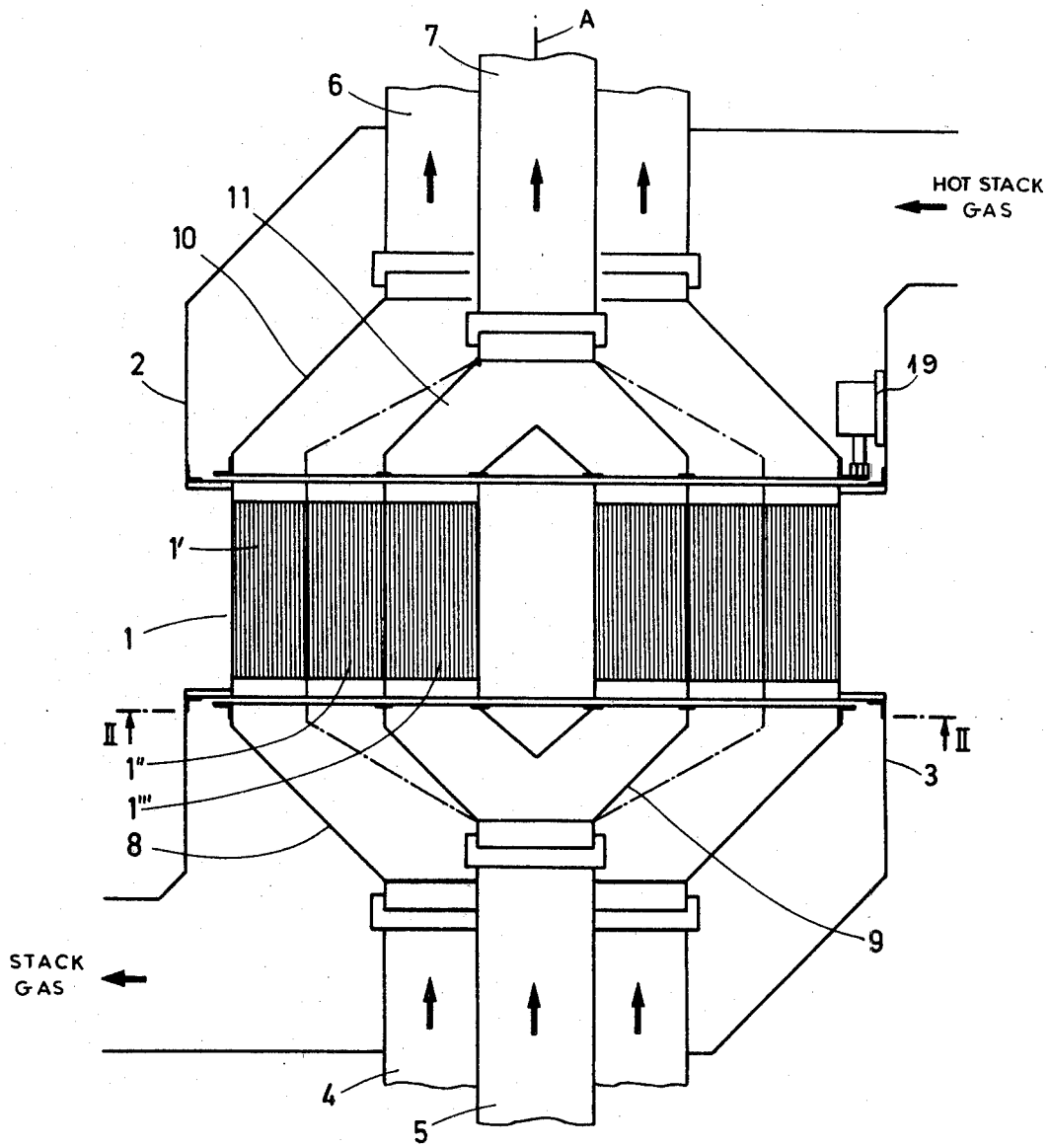
FIG. 1 is an axial section partly in schematic form through the apparatus of this invention.
Figure 2:
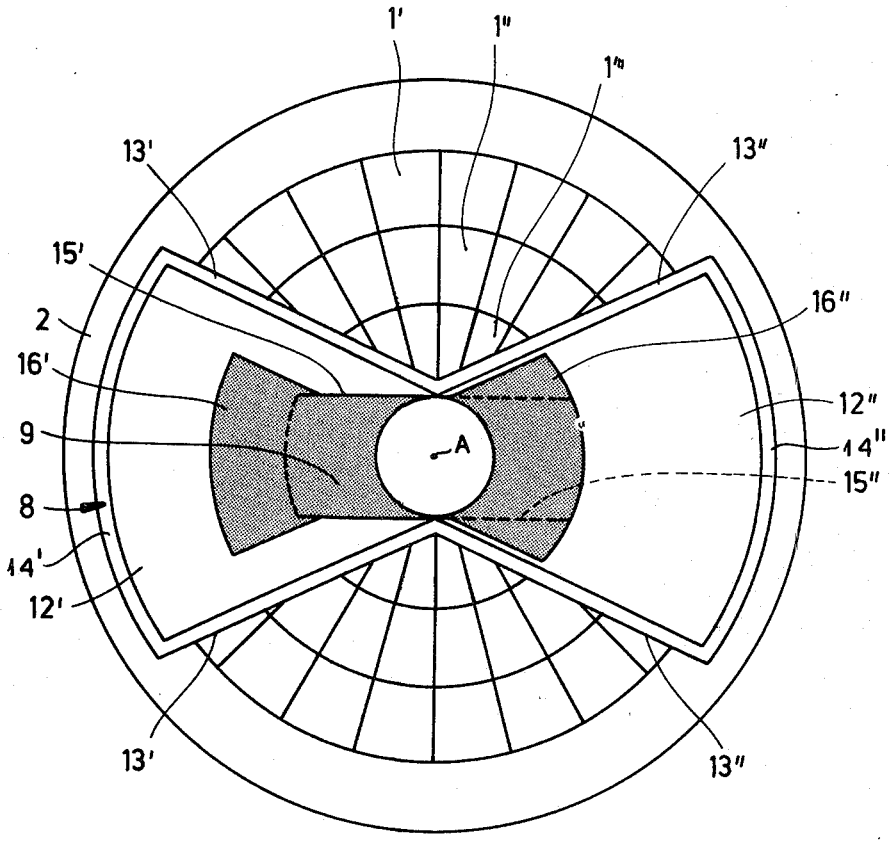
FIG. 2 is a section taken along line II—II of FIG. 1.

As seen in FIGS. 1 and 2 a multistream air preheater has a cylindrical sector plate 1 constituted by an appropriate thermal mass of great heat capacity and centered on an axis A. This plate 1 forms a multiplicity of axially throughgoing passages as is well known in the art. It is subdivided into an annulus of outer sectors 1', intermediate sectors 1'', and inner sectors 1'''. Normally at the center the plate 1 is not provided with thermal mass or thoughgoing passages.

An upper intake hood or plenum 2 receives hot stack gas, for instance from a coal burner, and channels it down into and axially through the plate 1. An output or exhaust hood 3 axially opposite, here underneath, the plate 1 receives the stack gas after it passes through the plate 1, giving up much of its heat to it, and channels it to further treatment, usually electrostatic filtering. The two heating gas hoods 2 and 3 are stationary, as is the sector plate 1.

Within the lower and upper hoods 3 and 2 are respective output and intake secondary hoods 8 and 10. Respective axially extending conduits 4 and 6 are connected to these hoods 8 and 10 to pass a secondary gas, normally air, to be heated through the plate 1, normally so the warmed air can be used as the combustion gas in a burner such as a coaldust-fired furnace. As seen in FIG. 2 the secondary hood 8, which is identical to the hood 10, is butterfly shaped. It has two generally radially extending pairs of side walls 13′ and 13″ defining with respective arcuate end walls 14′ and 14″ respective sector compartments 12′ and 12″ that open axially toward the plate 1 and that are connected to the respective conduit 6.

In turn, within the input and output secondary hoods 8 and 10 are respective input and output primary hoods 9 and 11. Respective axially extending conduits 5 and 7 are connected to these hoods 9 and 11 to pass a primary gas, normally air, to be heated through the plate 1. This air is under quite a bit more pressure than that of the secondary hoods 8 and 10 so it can, for instance, be used as a vehicle, dryer, and classifier for coal dust in a mill-/burner plant. As seen in FIG. 2 the primary hood 9, which is identical to the hood 11, is diametrally elongated and centered on the axis A. It has two pairs of secantally extending and aligned side walls 15′ and 15″ defining the respective hoods with respective U-shaped end walls 16′ and 16″. The hoods 8–11 are jointly synchronously rotatable relative to the hoods 2 and 3 and plate 1 about the axis A.

In use the gases flowing from the upper intake hood 2 through the plate 1 to the lower output hood 3 pass through the plate 3 all around the secondary hoods 8 and 10, heating this uncovered portion of the plate 1. Meanwhile means such as a motor 19 having a drive gear meshing with a circular rack carried on the hood 10 rotates the hoods 8–11 slowly and jointly about the axis A. Thus areas of the plate 1 heated by the gases passing between the hoods 2 and 3 come between the hoods 8 and 9 on one side and 20 and 11 on the other, while regions previously covered by these hoods 8–11 are exposed to the heated gas.

The gases passing from the intake conduits 4 and 5 to the upper output conduits 6 and 7 are heated by passing through the regions of the plate that have been heated by the gases passing countercurrent through the plate 1 between the hoods 2 and 3. The heat exchange is considerable, and the leakage between the heated gas stream, the primary gas stream, and the secondary gas stream can be held fairly low.

The walls 16′ and 16″ can move radially between the inner position shown in solid lines in FIG. 1 and to the right in FIG. 2 and outer positions shown in dot-dash lines in FIG. 1 and to the left in FIG. 2. When in the outer positions they maximize the flow cross section of the primary hoods 9 and 11 since they allow primary gas flow through inner sectors 1‴ as well as through intermediate sectors 1″ and while in the inner positions they minimize such primary gas flow, since flow is limited to the inner sectors 1‴. Thus the position of these end walls, which is established by the operator of the system by bolting them in the desired position, determines the relative flow cross sections defined by the secondary hoods 8 and 10 and by the primary hoods 9 and 11. The size of the flow cross section in turn determines the extent of heat exchange, so that the positions of the end walls 16′ and 16″ will establish the relative temparatures of the exiting primary and secondary gases.

Figure 3:
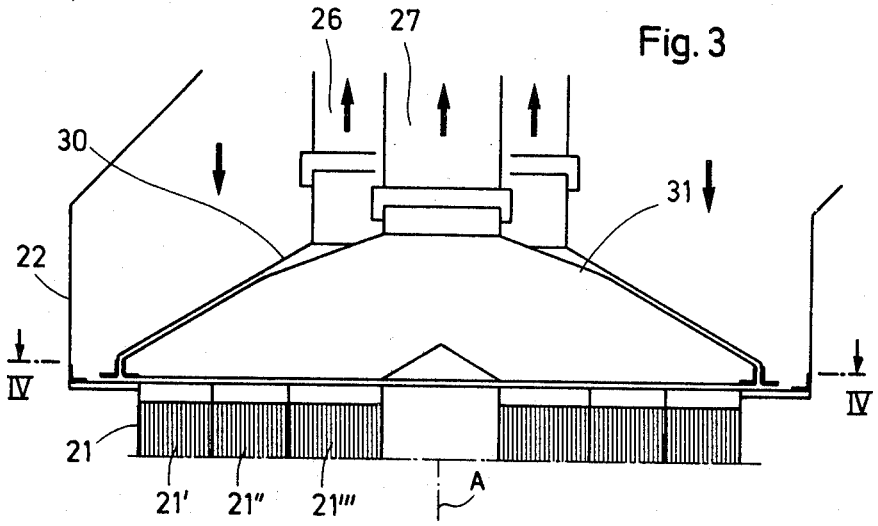
FIG. 3 is a section like FIG. 1 through the top half of a second embodiment of the apparatus of this invention.
Figure 4:
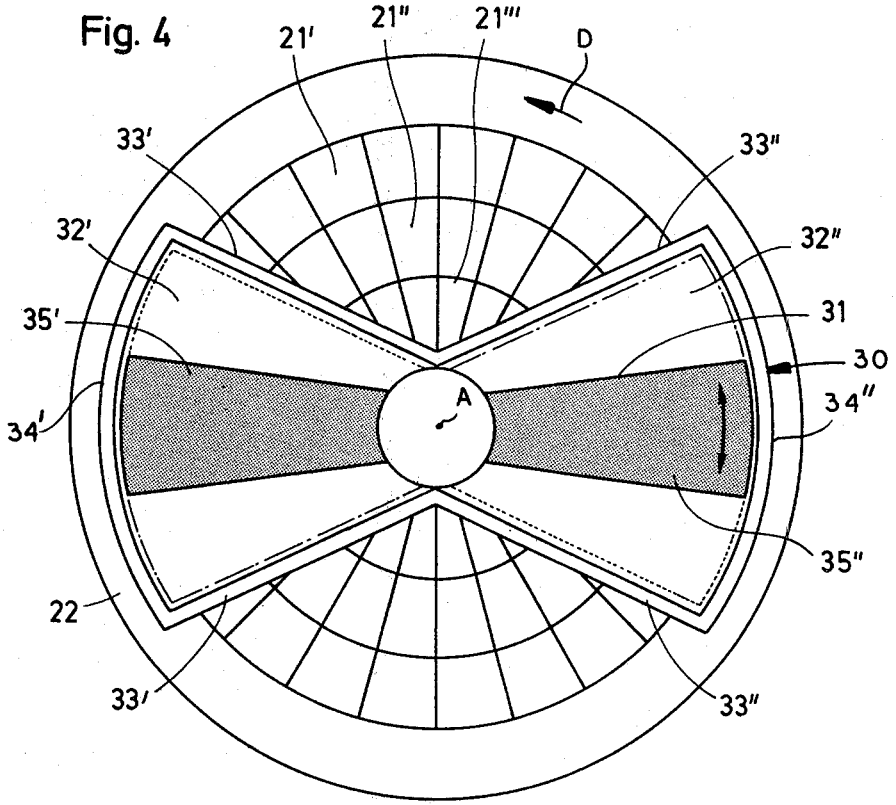
FIG. 4 is a section taken along line IV—IV of FIG. 3.

In FIGS. 3 and 4, as in the balance of this description, only the top half of another embodiment of this invention is shown. It is understood that the top and bottom halves are substantially identical. Here a sector plate 21 subdivided into rings of outer sectors 21′, intermediate sectors 21″, and inner sectors 21‴ lies underneath a heating gas intake hood 22 identical to the hood 2 of FIG. 1. Within this hood 22 is a butterfly-section secondary gas output hood 30 connected to a conduit 26 and substantially identical to the hood 10 of FIG. 1, here formed with side walls 33′ and 33″ terminating in end walls 34′ and 34″ and defining compartments 32′ and 32″.

In this arrangement a secondary-gas hood 31 is also of butterfly section and is radially coextensive with the hood 30. This hood 31 defines compartments 35′ and 35″ within the compartments 32′ and 32″ and is connected to its own output conduit 27. Heat exchange is varied in this embodiment by pivoting of the primary hoods relative to the secondary hoods. Assuming that the hoods 30 and 31 are rotating in the direction D about the axis A, when the hood 31 is in the dot-dash-line position, that is with the compartments 35′ and 35″ leading the compartments 32′ and 32″, heat exchange will be maximized. This is due to the fact that the primary gas will be exposed to the heated regions of the plate 21 before the secondary gas. When in the opposite end position shown in dotted lines heat exchange will be minimized. This relative position can be set relatively easily from outside the apparatus, either manually or by means of an automatic control system responding to gas temperature.

Figure 5:
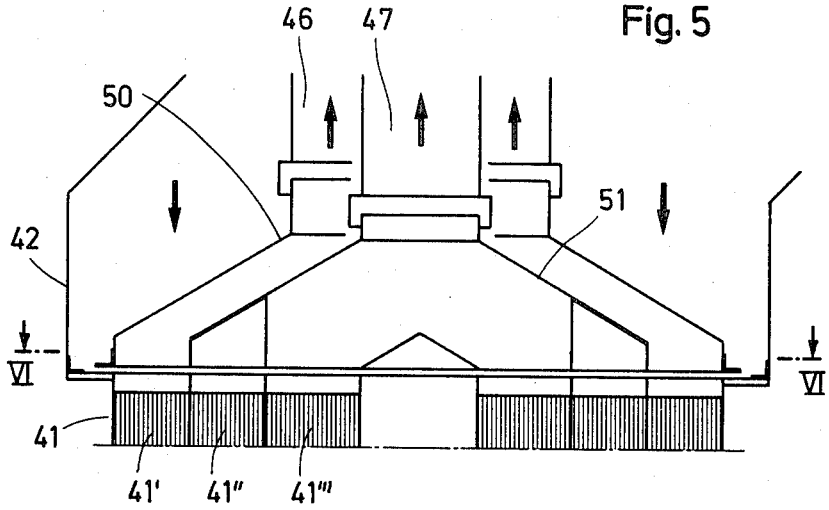
FIG. 5 is a section like FIG. 1 through the top half of a third embodiment of the apparatus of this invention.
Figure 6:
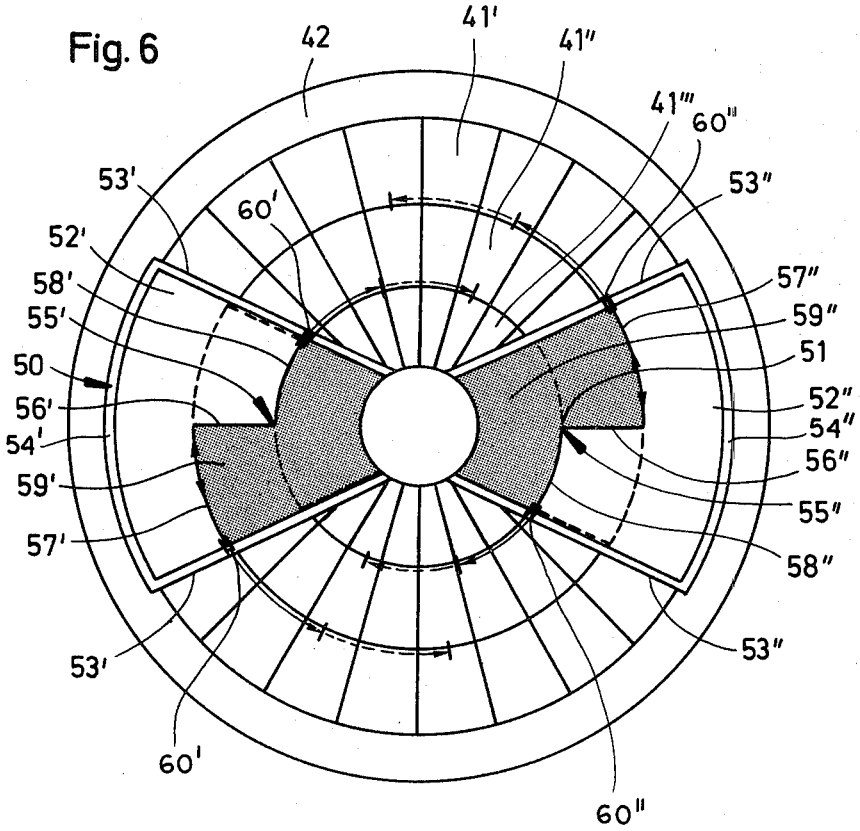
FIG. 6 is a section taken along line VI—VI of FIG. 5.

FIGS. 5 and 6 show the top half of another embodiment of this invention. Here a sector plate 41 subdivided into rings of outer sectors 41′, intermediate sectors 41″, and inner sectors 41‴ lies underneath a heating gas intake hood 42 identical to the hood 2 of FIG. 1. Within this hood 42 is a butterfly-section secondary gas output hood 50 connected to a conduit 46 and substantially identical to the hood 10 of FIG. 1, here formed with side walls 53′ and 53″ terminating in end walls 54′ and 54″ and defining compartments 52′ and 52″.

In this arrangement a secondary-gas hood 51 is also of butterfly section and has side walls formed by the walls 53′ and 53″ so that it lies radially within the compartments 52′ and 52″. Respective end walls 55′ and 55″ define the radial outer limits of primary-hood compartments 59′ and 59″ and inner limits of the secondary hood compartments 52′ and 52″. These walls 55′ and 55″ have respective arcuate inner sections 58′ and 58″, respective arcuate outer sections 57′ and 57″ centered like the sections 58′ and 58″ on the axis A and respective intermediate sections 56′ and 56″ that extend radially between the respective inner sections 58′ and 58″ and outer sections 57′ and 57″. The walls 53′ and 53″ are formed with axially extending and angularly throughgoing slots 60′ and 60″ in which the arcuate walls 57′, 57″, 58′, and 58″ can slide angularly. Each of these walls 57′, 57′, 58′, and 58″ is angularly long enough to bridge the respective side walls 53′ and 53″.

Thus heat exchange is adjusted in this system by sliding the walls 55′ and 55″ angularly to one side or the other. When slid all the way over so that the inner portions 58′ and 58″ are pushed wholly out of the compartments 52′ and 52″ the flow cross section is maximized to include intermediate sectors 41″ and inner sectors 41‴. When pushed angularly in the opposite direction flow section and heat exchange with the primary gas is minimized, being restricted to the inner sectors 41‴.

Figure 7:
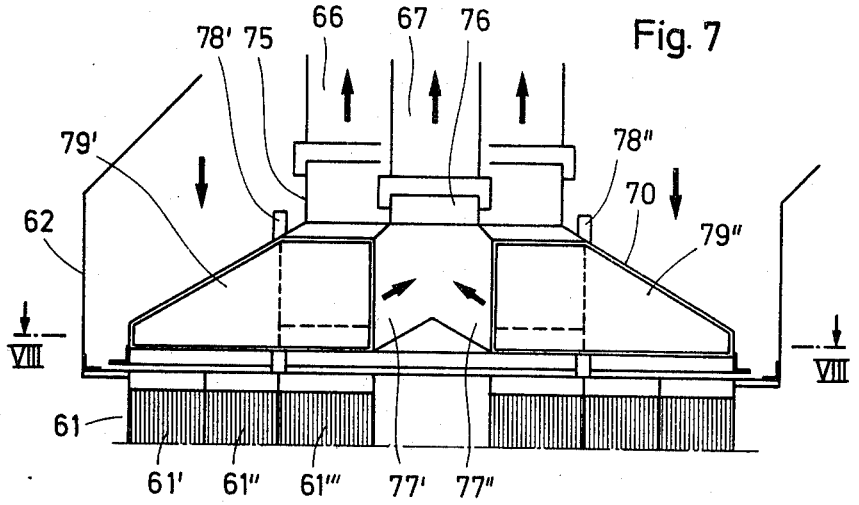
FIG. 7 is a section like FIG. 1 through the top half of a fourth embodiment of the apparatus of this invention.
Figure 8:
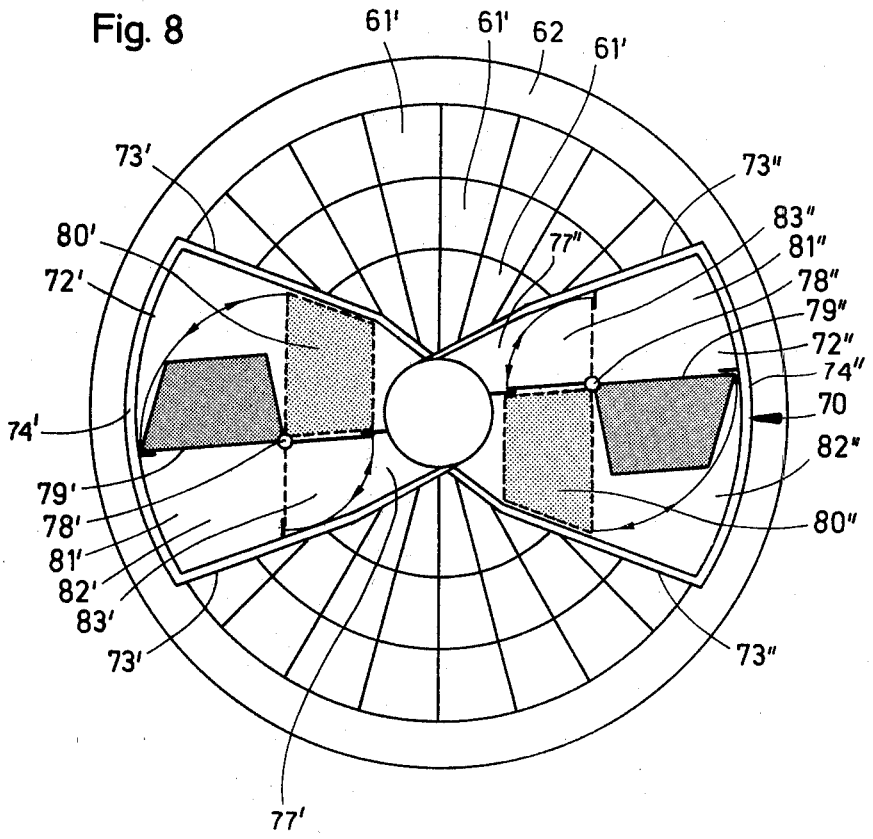
FIG. 8 is a section taken along line VIII—VIII of FIG. 7.

FIGS. 7 and 8 show the top half of another embodiment of this invention. Here a sector plate 61 subdivided into rings of outer sectors 61′, intermediate sectors 61″, and inner sectors 61‴ lies underneath a heating gas intake hood 62 identical to the hood 2 of FIG. 1. Within this hood 62 is a butterfly-section secondary gas output hood 70 connected to a conduit 66 and substantially identical to the hood 10 of FIG. 1, here formed with side walls 73' and 73'' terminating in end walls 74' and 74'' and defining compartments 72' and 72''.

A secondary gas conduit 67 extending up along the axis A has at its lower end a wye 76 with two branches 77' and 77'' opening into respective inner compartments 83' and 83'' for the primary gas. Central pivots 78' and 78'' in the compartments 72' and 72'' support double flaps or doors 79' and 79'' that can move between radial positions opening up portions 81' and 81'' of the compartments 72' and 72'' to the compartments 83' and 83'' and angular positions opening up inner portions 80' and 80'' to the compartments 83' and 83''.

Thus the flaps 79' and 79'', which are shaped to fit under the frustoconical hood roof, can switch the primary-gas compartment from a position angularly leading or trailing the secondary gas compartment to a position radially within the secondary gas compartment. In the latter position rotation direction of the primary and secondary hoods on the plate 1 is irrelevant. The pivoting can be carried out relatively easily and, as in the other embodiments, only one side of the primary hood need be adjusted for a modest heat-exchange change.

Figure 9:
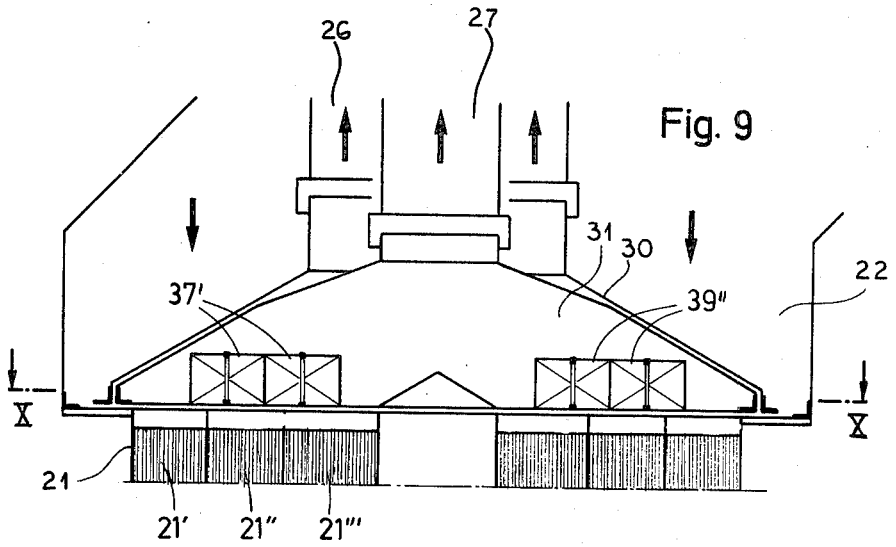
FIG. 9 is a section like FIG. 1 through the top half of a fifth embodiment of the apparatus of this invention.
Figure 10:
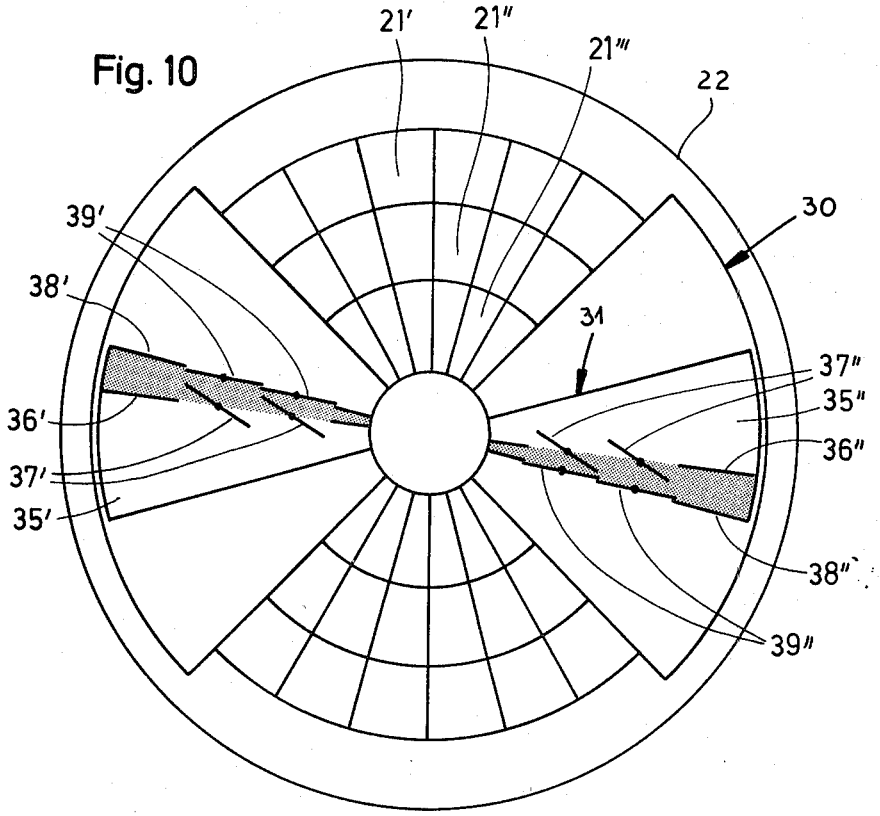
FIG. 10 is a section taken along line X—X of FIG. 9.

FIGS. 9 and 10 show the top half of another embodiment of this invention which has much of the same structure and references as FIGS. 3 and 4. The main difference is that primary-gas hood 31 is not angularly displaceable in the secondary gas hood 30, but instead has radially extending inner side walls 36' and 36'' defining the compartments 35' and 35'' that are connected to the conduit 27, and spaced angularly from the outer side walls 38' and 38'' that define compartments that open axially toward the plate 1 but that are not connected to any of the conduits.

Doors or flaps 37', 37'' and 39', 39'' can pivot to close ports in the respective walls 36', 36'' and 38', 38''. These flaps are opened and closed alternately. In the illustrated position the doors 37' and 37'' are open and the doors 39' and 39'' are closed to increase the flow cross section of the primary hood 31 at the expense of that of the secondary hood 30. It is similarly possible to increase the flow cross section of the secondary hood 30 at the expense of that of the primary hood.

Figure 11:
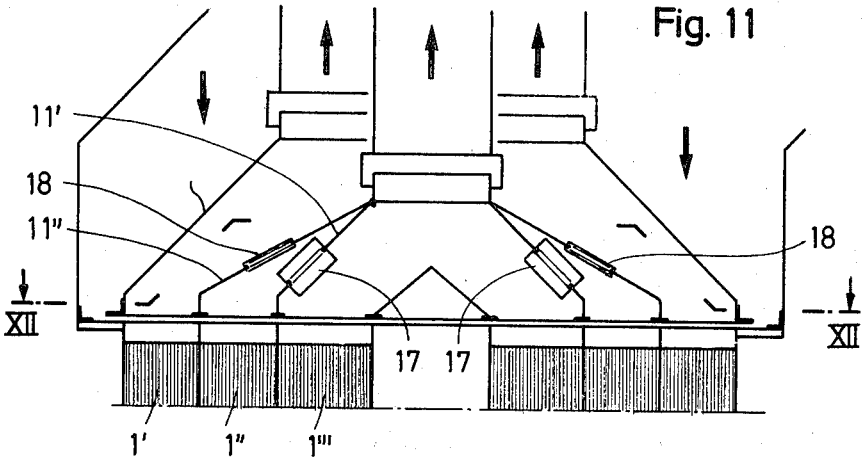
FIG. 11 is a section like FIG. 1 through the top half of a sixth embodiment of the apparatus of this invention.
Figure 12:
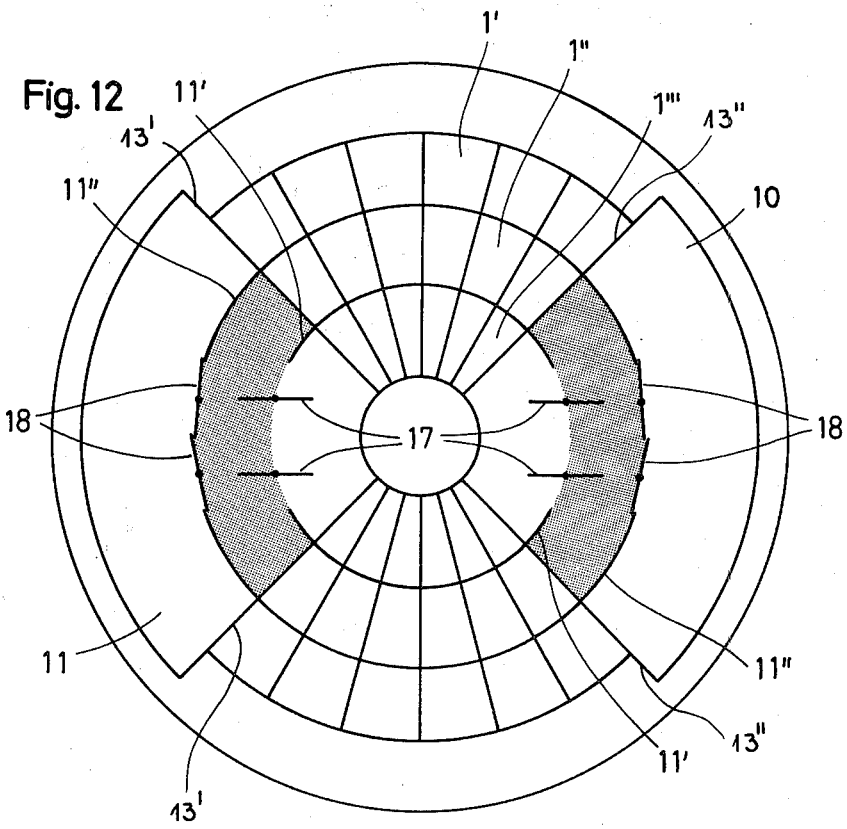
FIG. 12 is a section taken along line XII—XII of FIG. 11.

FIGS. 11 and 12 show the top half of another embodiment of this invention which has much of the same structure and references as FIGS. 1 and 2. The main difference is that primary-gas hood 11 can have its flow cross section increased in a manner similar to that described above with reference to FIGS. 9 and 10. To this end the primary hood 11 has an angularly extending inner end wall 11' and the hood 10 has an angularly extending inner wall 11'' spaced radially outward from the wall 11' and bridging the walls 13' and 13'' like the wall 11'. Pivotal doors or flaps 17 and 18 are provided at ports in the walls 11' and 11'' so that this area (shaded in the drawing) between the walls 11' can be added to the primary or secondary hood. As mentioned above the doors 17 on one side could be opened with the corresponding doors 18 closed, and the opposite condition could reign on the other side for fine adjustment of the heat-exchange rate.

The above-described systems can be operated in accordance with the above-mentioned U.S. patent application to prevent leakage beween the various hoods where they ride on the sector plate. Thus the sector plate has an outer support ring centered on an axis and normally of cylindrical shape, an inner support ring centered on the axis, and a plurality of radially extending walls lying generally in axial planes and having outer ends fixed to the outer ring and inner ends and guided on the inner ring. A plurality of angularly extending and radially spaced annular walls extend between the radial walls and form therewith axially throughgoing passages. Thus when hot gases flow in one axial direction through the passages they thermally deform the radial walls so that their ends move into a position at an angle to each other. Means is provided for thermally deforming the outer ring to a taper equal to twice this angle for holding the inner ends of the radial walls and the inner ring axially level with the outer ring when hot gases flow through the passages. Further reference should be made to this earlier application and to the references cited therein for more details.

We claim:

1. A regenerative air preheater comprising:

a heat-exchange sector plate centered on an axis and formed with a multiplicity of axially throughgoing passages;

intake and output heating-gas hoods axially flanking the plate;

conduit means for passing a heating gas from the intake hood through the plate to the output hood for heating the plate;

intake and output secondary heated-gas hoods each within one of the heating-gas hoods and axially flanking the plate, the secondary hoods being axially aligned with each other and only covering a portion of the plate, whereby the heating gas can pass through the plate only around the plate portion covered by the secondary hoods;

conduit means for passing a secondary stream of a gas to be heated from the intake secondary hood through the plate at the plate portion covered by the secondary hoods to the output secondary hood;

drive means for rotating the secondary hoods synchronously with each other about the axis in a predetermined rotational sense, whereby the heating gas will heat regions of the plate not covered by the secondary hoods so that when same move into alignment with these heated regions the secondary gas stream will be heated;

intake and output primary heated-gas hoods within the respective secondary hoods and axially flanking the plate, the primary hoods being axially aligned with each other and only covering a subportion of the plate portion covered by the secondary hoods, whereby the secondary gas will be heated at regions of the plate portion not covered by the primary hoods;

conduit means for passing a primary stream of a gas to be heated from the intake primary hood through the plate subportion aligned with it to the output primary hood; and control means for displacing the primary hoods at least partially nonaxially within the respective secondary hoods and thereby varying the heat-exchange between the primary stream and the plate.

2. The multistream regenerative preheater defined in claim 1 wherein the primary hoods are generally radially coextensive with the respective secondary hoods and are movable angularly therein, whereby the subportion of the primary hoods can lead the portion of the second hoods relative to the rotational sense to increase heat exchange with the primary stream and can follow it to decrease such heat exchange.

3. The multistream regenerative preheater defined in claim 1 wherein the primary hoods each have at least one wall movable nonaxially in and at least partially bounding the respective secondary hoods.

4. The multistream regenerative preheater defined in claim 2 wherein the walls are each movable radially in the respective secondary hoods between an outer position maximizing the area of the subportion and thereby maximizing the heat exchange and an inner position minimizing the area and heat exchange.

5. The multistream regenerative preheater defined in claim 4 wherein the radially movable walls are U-shaped and open toward the axis.

6. The multistream regenerative preheater defined in claim 2 wherein the secondary hoods each have at least two generally radially extending side walls angularly bounding the respective portion.

7. The multistream regenerative preheater defined in claim 6 wherein the movable walls each include an angularly extending outer portion, an angularly extending inner portion spaced radially inward from the respective outer portion, and an intermediate portion extending angularly between the respective inner and outer portions, the side walls of the secondary hoods having inner and outer slots receiving the respective portions, the movable wall being angularly shiftable in the slots between a position with the intermediate portion against one side wall and the outer portion generally bridging the side walls and a position with the intermediate portion against the other side wall and the inner portion generally bridging the side walls.

8. The multistream regenerative preheater defined in claim 6 wherein the primary-gas conduit means opens generally at the axis into the primary hoods and the secondary-gas conduit means opens offset from the axis into the secondary hoods, the movable walls each being displaceable between a position extending generally radially between the respective side walls with the primary and secondary hoods generally radially coextensive, and a position extending secantally between the respective side walls with the primary hood between the secondary hood and the axis.

* * * * *